United States Patent [19]

Gilly

[11] Patent Number: 4,519,608

[45] Date of Patent: May 28, 1985

[54] TENNIS RACKET STROKE TRAINING DEVICE

[76] Inventor: Pierre E. Gilly, 13 rue des Abondances, Boulogne (Hauts de Seine), France

[21] Appl. No.: 414,914

[22] Filed: Sep. 3, 1982

[30] Foreign Application Priority Data

Sep. 29, 1981 [FR] France ..... 81 18332

[51] Int. Cl.[3] ..... A63B 69/38

[52] U.S. Cl. ..... 273/29 A; 273/183 B

[58] Field of Search ..... 273/29 A, 188 R, DIG. 19, 273/191 B, 183 B, 186 R, 191 R, 192, 191 A, 186 C, 26 R, DIG. 17; 272/119, 143

[56] References Cited

U.S. PATENT DOCUMENTS 4,272,072 6/1981 Kusmer ..... 272/143

FOREIGN PATENT DOCUMENTS 932757 8/1973 Canada ..... 273/188 R

*Primary Examiner*—Richard C. Pinkham
*Assistant Examiner*—T. Brown
*Attorney, Agent, or Firm*—Murray Schaffer

[57] ABSTRACT

A tennis training device worn by a player and comprising a telescopic and orientable rod—attached to a wide belt—in the dorsal region—thereof and bearing at its end an obstacle—the position of which is adjusted in order to define the place where the player's racket is required to come to rest in the correct execution of a stroke of a definite type. The player is immediately aware, by a direct physical sensation, whether or not he has executed the stroke correctly.

7 Claims, 5 Drawing Figures

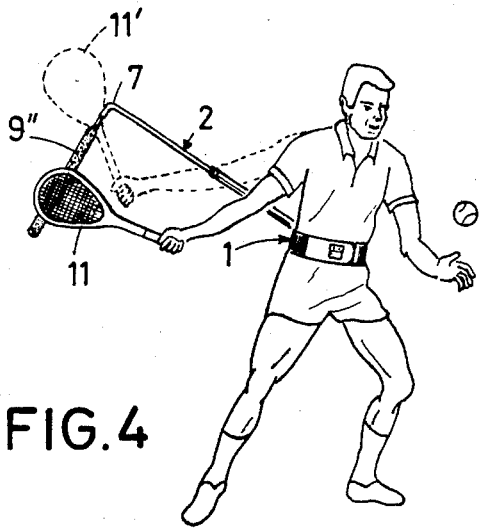
FIG. 4
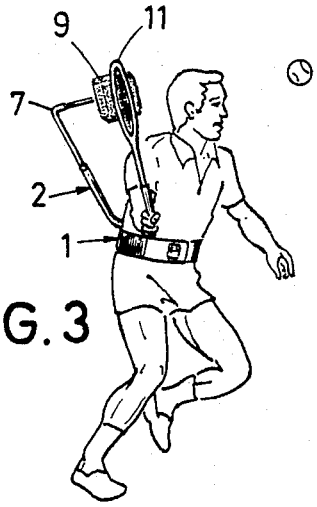
FIG. 3
FIG. 5
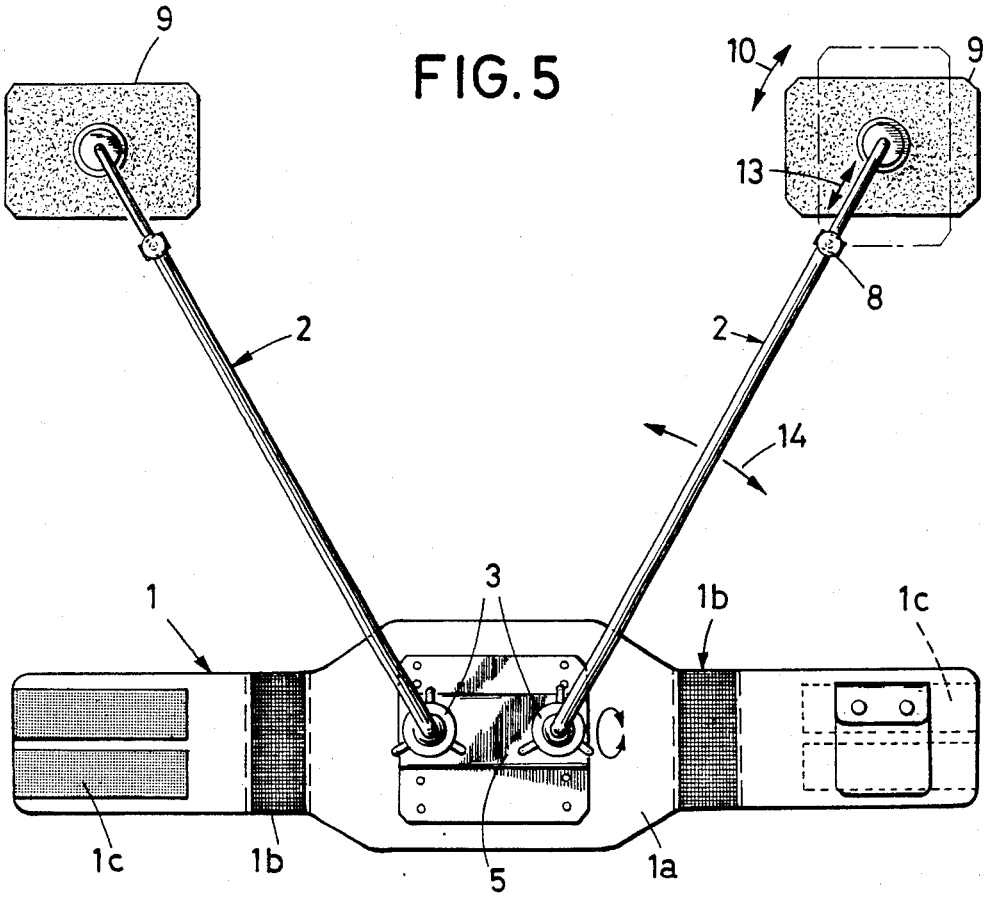

TENNIS RACKET STROKE TRAINING DEVICE

BACKGROUND OF THE INVENTION

Teaching to play tennis well is a difficult undertaking. Teachers and coaches find very frequently that their pupils execute poorly the movements which are taught them, whilst being convinced that their movements are correct. In other words, the pupils do not always have an exact awareness of the movements which they actually perform. More generally, it seems that one of the difficulties of tennis is for a player (beginner or experienced) to know what he is doing, which does not necessarily coincide with what he believes he is doing.

In order to overcome this troublesome phenomenon, it is known to record the pupils or the trainees on a video recorder in the course of their study of the various movements of tennis, in order to show them afterwards, by their own image, their behaviour in the execution of these movements. However, this method has limited efficacity because it permits only a belated check due to the inevitable interval of time in practice between the actual game and its replay by video recorder to the player; it is also not uncommon for the latter, although he has seen his faults on the picture, to repeat the same faults at the next lesson.

The invention aims to produce a training device capable of giving the player immediate information on the manner in which he executes the various tennis strokes.

SUMMARY OF THE INVENTION

Such a device, which permits the player to check the technical quality of his movements during the actual execution of the strokes, comprises according to the invention an object capable of constituting an obstacle for the player's racket, said object being mounted on an adjustable fitting attached rigidly to the player's back and permitting the object to be arranged in a position close to that which the racket is required to assume at one end of its travel during the execution of a definite stroke.

The device according to the invention therefore provides the player, with whom it is integral, with a reference element consisting of the aforesaid object, which enables him to be aware at each stroke played whether or not he has maneuvered his racket correctly. The latter, in striking the obstacle, gives the player an immediate and concrete sensation which indicates to him whether his movement is correct, or too high, too low, too short, too wide, too early or too late with reference to the ball to be returned, without the possibility of the slightest doubt in his mind. According to the type of obstacle used, the latter may even provide information on the angle of inclination of the plane of the racket. As a result, the player is thus "physically" aware of his exact movements at the very moment when he performs them, which is much more advantageous for him than the belated observation of his image recorded on the video recorder. Moreover, the device according to the invention is simple and inexpensive. It is light and its presence in no way hampers the player, who retains his total liberty of play. Used normally on a tennis court, it may likewise be used at home in order to work on the execution of this or that movement and to acquire by training a faculty of quasi automatic execution of the various tennis strokes (shadow tennis).

The position of the obstacle/object can be adjusted in order to check the position either of preparation, or of completion of the strokes. It may be arranged both on the player's right and left, depending upon the type of strokes to be studied. Its position can be modified gradually in order to effect a progressive correction of a player's faults on a particular stroke.

In a preferred embodiment of the device according to the invention, the fitting of the latter comprises a telescopic rod bent in the region of its ends and orientable about its end of attachment to the dorsal region of a harness worn by the player, whilst the aforesaid object is attached to its other end. It is advantageous for this harness to consist simply of a wide abdominal belt, which forms a stable support for said telescopic rod without creating any encumbrance of the player's movements.

The telescopic rod, preferably attached to the harness by means of a lockable ball and socket joint, is advantageously formed by two straight segments able to slide and turn in one another and to be mutually locked in the chosen position. The length of the rod and the orientation of the obstacle/object attached to its end can thus be adjusted easily. To enable the various configurations which the device can assume to be characterized easily, it is appropriate to associate reference graduations with the members which it comprises to permit its adjustment (such as a ball and socket joint and movable segments of a telescopic rod).

To prevent any harsh impact of the racket against the obstacle/object, the latter preferably exhibits a flexible structure. It may on the other hand be devised either to constitute an obstacle which cannot be crossed by the racket, or to constitute an obstacle which can be crossed by the racket, then giving the player an indication relating to the position of his racket, but without preventing the latter from continuing its backward movement. In the former case, the object may be a simple block of elastic material e.g. in the form of a rectangular panel or a ball, firmly attached to its supporting fitting. In the latter case, it may be constructed in the form of a flexible staff arranged in a substantially vertical plane and preferably directed downwards.

As a variant, a device according to the invention may be double and comprise a second fitting carrying a second object adjustable in position independently of that of the first object, these complementary elements being constituted and arranged in the manner previously described. The player then has available simultaneously two obstacle/objects which permit him to study the execution of two types of strokes in one and the same practice session.

The description to be given, with reference to the drawings appended by way of non-limitative examples, will enable the manner in which the present invention can be embodied to be fully understood.

BRIEF DESCRIPTION OF THE DRAWINGS

FIGS. 3 and 4 show a player using a device according to the invention in two different configurations.

FIG. 5 shows as a variant a double device, viewed in plan.

DETAILED DESCRIPTION

Figure 1:
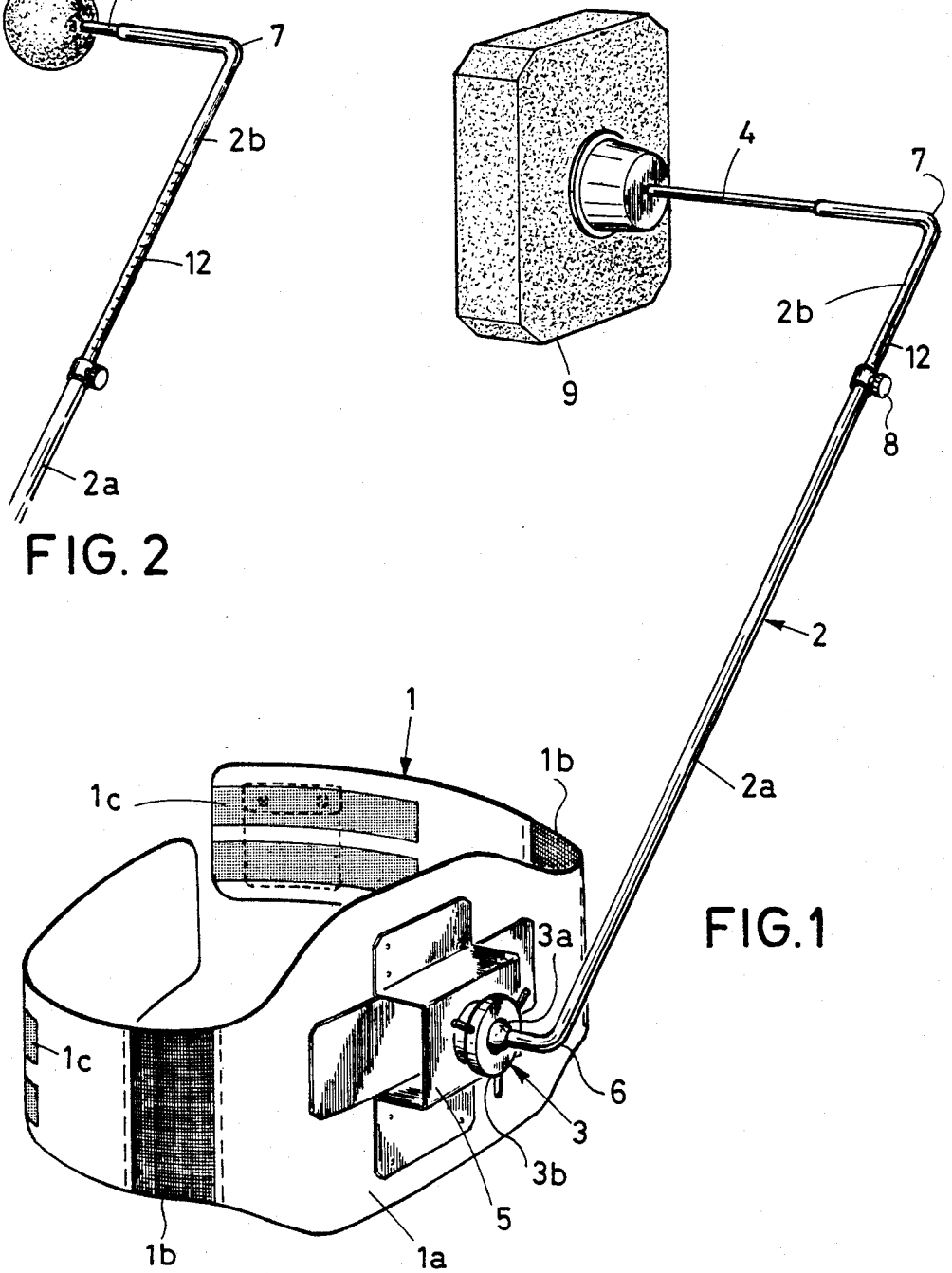
FIG. 1 shows in perspective a device according to the invention.

According to FIG. 1, the device given as an example substantially comprises a support consisting of a wide abdominal belt 1 and a rigid telescopic rod 2, orientable practically in all directions by virtue of a ball and socket joint 3 which connects one end of it to the center of the dorsal part 1*a* of the belt 1, whereas its other end bears an object 9 of flexible material, capable of forming an obstacle for the tennis racket of a player equipped with the device.

The belt 1, of leather or plastic, comprises lateral portions 1*b* of elastic fabric and is closed by means of attachments 1*c* of the "Velcro" type. On its dorsal part 1*a*, widened to form a stable surface of support, a base 5 is attached supporting the ball and socket joint 3. The ball 3*a* of the latter, which can be locked in any desired position by operating a screw-threaded ring 3*b*, is attached to the end of the first tubular segment 2*a* of the telescopic rod 2, bent at a right angle at 6 at a short distance from the ball 3*a*. The second segment 2*b* of said rod, likewise tubular and bent at a right angle at 7 near its end, can turn and slide in the first segment and be locked therein in any desired position by means of a knurled headed screw 8 (an eccentric roller locking system which is easier to handle, could likewise be used here).

Figure 2:
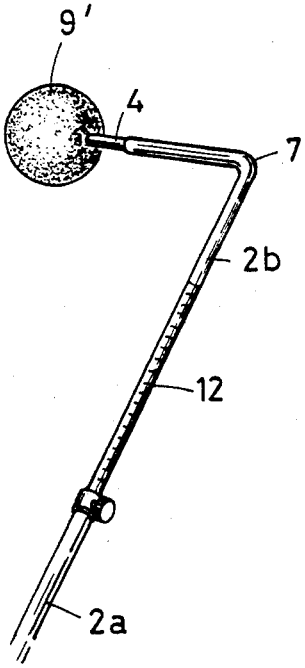
FIG. 2 shows the end of the telescopic rod of the device of FIG. 1, equipped with an obstacle of a different shape.

The aforesaid object of flexible material, namely a thick rectangular panel 9 of plastic foam, is mounted on the end of the rod 2 thus constituted, by means of a short connecting rod 4. The object may also be (FIG. 2) a ball 9' of flexible plastic foam, or again (FIG. 4) a flexible staff 9'', preferably wrapped in a sheath of elastic foam.

FIGS. 3 and 4 show two examples of the use of a device according to the invention worn by a player after having tightened the belt 1 round his waist, the rod 2 projecting laterally from his back. In the case of FIG. 3, the device is adjusted for the study of volley strokes; it is equipped with a panel 9 arranged in a substantially frontal plane, the terminal bend 7 of the rod 2 being oriented forwards. This panel constitutes a stop defining the correct position of the player's racket 11 at the end of preparation, which is in principle adjusted so as not to be touched by the racket. Any contact immediately warns the player that he is moving his racket 11 too far backwards. In the case of FIG. 4, the device, equipped with a flexible staff 9'', is adjusted for the study of the forehand stroke. The staff 9'' is oriented downwards substantially in a vertical plane, the bend 7 being turned downwards for that purpose. Here, the staff 9'', contrarily to the objects 9 and 9', constitutes an obstacle which can be crossed by the racket 11, at the passage of which it yields by bending, so that it can reach a more withdrawn terminal position 1', whilst the player has been informed by the momentary contact with the staff 9'' that his racket was reaching the correct position.

In FIGS. 3 and 4 the rod 2 of the device is oriented towards the player's right. It may equally well be oriented towards his left, for the purpose of studying backhand strokes.

The various adjustments of the device may be referenced by graduations or appropriate marks which avoid trial and error in finding an adjustment decided previously. For example, a scale of graduations 12 may be written on the segment 2*b* of the telescopic rod 2, permitting the extension given to that rod to be referenced. The ball 3*a* of the joint 3 may also be provided with colored rings characterizing the orientation given to the rod 2.

By way of indication, in a concrete exemplary embodiment, the belt 1 exhibits a width of 14 cm, increased to 23 cm in its dorsal region 1*a*. The rod 2, the bend 6 of which is offset approximately 10 cm to the rear with reference to the said region 1*a* of the belt, consists of two straight segments 2*a*, 2*b* of approximately 50 cm. The main dimensions of the panel 9 are 15×22 cm, the ball 9' has a diameter of 6.5 cm and the flexible staff 9'' has a length of approximately 40 cm.

FIG. 5 illustrates a variant of embodiment. This is a double device comprising, supported by a common base 5 attached to the belt 1, two similar telescopic and orientable rods 2, adjustable mutually independently. As in the simple device previously described, each rod 2 is on the one hand extensible and retractable according to the double arrow 13, and on the other hand orientable in any direction according to the double arrow 14, and also forwards or backwards by virtue of a respective ball and socket joint 3, each obstacle 9 being itself orientable in its plane according to the double arrow 10. The player thus has two obstacles 9 available, located e.g. one on his right, the other on his left, and identical or different, which permit him to check both his forehand strokes and his backhand strokes.

I claim:

1. A training device for a tennis player, comprising a harness having a dorsal part and being adapted to be worn on the torso of the player, a telescopic rod having means at one end constituting an abstacle for the player's racket and being adjustably attached at its other end to the center of said dorsal part by a ball and socket joint, so that the obstacle means may be selectively arranged in a position close to that which the racket is required to assume at one end of its travel during the execution of a predetermined stroke.

2. A device as claimed in claim 1, wheren said harness consists of a wide abdominal belt.

3. A device as claimed in claim 1, wherein said ball and socket joint is a lockable joint.

4. A device as claimed in claim 1, wherein said telescopic rod is formed by two straight segments adapted to slide and turn in one another and to be mutualy locked in the chosen position.

5. A device as claimed in claim 1, wherein said obstacle means comprises a thick rectangular panel of plastic foam.

6. A device as claimed in claim 1, wherein said obstacle means comprises a flexible staff of plastic foam oriented downwards substantially in a vertical plane and able to yield by bending.

7. A device as claimed in any one of claims 1 or 2 to 6, including a second ball and socket joint carrying a second telescopic rod and obstacle means, adjustable in position independently of and complementary to that of the first rod and obstacle means.

* * * * *